United States Patent [19]

Butler

[11] Patent Number: 4,961,271

[45] Date of Patent: Oct. 9, 1990

[54] APPARATUS FOR TREATING FURNITURE

[76] Inventor: Christopher S. Butler, 2750 Northaven #207, Dallas, Tex. 75229

[21] Appl. No.: 328,686

[22] Filed: Mar. 27, 1989

[51] Int. Cl.[5] ..... F26B 19/00

[52] U.S. Cl. ..... 34/60; 34/61; 34/72; 34/91; 34/218; 34/223; 34/225

[58] Field of Search ..... 34/232, 233, 151, 90, 34/17, 19, 12, 60, 72, 91, 218, 223, 224, 225

[56] References Cited

FOREIGN PATENT DOCUMENTS 1111219 12/1961 Fed. Rep. of Germany ..... 34/151

1279990 11/1960 France ..... 34/151

*Primary Examiner*—Henry A. Bennet

*Attorney, Agent, or Firm*—Timmons & Kelly

[57] ABSTRACT

Disclosed is an apparatus for treating furniture that has been wet cleaned or damaged by water or smoke. The apparatus is a tent having a floor, a plurality of sides, and a top, forming an enclosed chamber. The furniture is placed on the floor within the sides, and the top is attached to the sides. Air or ozone is then blown into the chamber to inflate the tent. A plurality of holes in the top of the tent or exhaust boots in the sides of the tent allow the air or ozone to escape from the chamber at a selected rate to maintain the inflation of the tent.

12 Claims, 1 Drawing Sheet

APPARATUS FOR TREATING FURNITURE

BACKGROUND OF THE INVENTION

1. Field of the Invention

This invention relates in general to the treatment of furniture that has been wet cleaned or damaged by water or smoke. In particular, the invention relates to an apparatus for blowing air or ozone through a portable tent containing furniture.

2. Description of the Prior Art

During a fire, furniture may sustain damage from smoke and water, as well as from the fire itself. After a fire, the furniture may be wet and may have a smoky odor. The furniture may be dried by blowing air across the furniture to cause the water to evaporate. The smoky odor may be removed by blowing ozone over the furniture. Furniture that has been wet cleaned may also be dried by blowing air across the furniture.

Typically, the wet or smoke and water damaged furniture is transported to a special room, where air and ozone are blown over the furniture. It normally takes about two to three hours to blow furniture dry in such a room.

It is desirable to reduce costs by providing a portable drying chamber. Such a chamber eliminates the cost of transporting the furniture. It is also desirable to reduce the time required to complete the drying process.

SUMMARY OF THE INVENTION

The apparatus of the invention is a drying tent that can be transported to the site of the furniture, thus eliminating the cost of transporting the furniture. The tent has a canvas floor and lightweight plastic sides. Water or smoke damaged furniture can be placed on the floor within the sides of the tent. A lightweight plastic top is then attached to the sides of the tent.

A fan is then activated to blow air into the chamber formed by the floor, sides, and top of the tent. The air inflates the chamber, causing the top and sides to rise from the bottom of the tent.

If ozone is used, the ozone is blown into the chamber near the top of the tent and at an angle to the left. This causes the ozone to spiral downward through the chamber in a clockwise direction. The ozone is blown into the chamber near the top because ozone is heavier than air and will tend to fall.

DESCRIPTION OF THE PREFERRED EMBODIMENT

Figure 1:
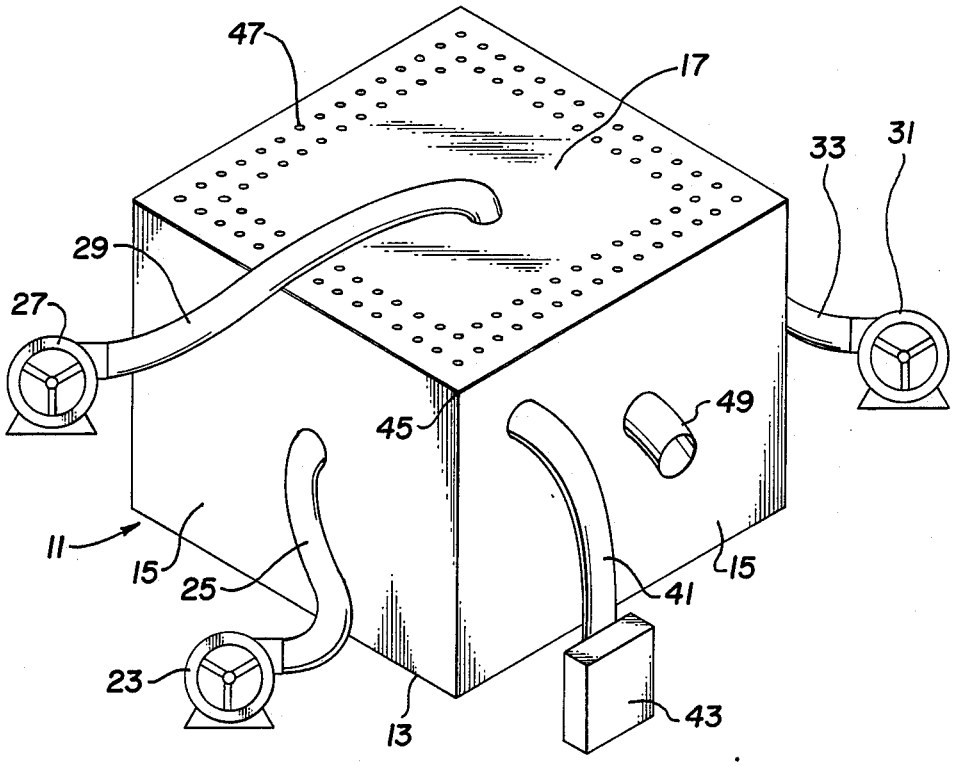
FIG. 1 is a perspective view of the apparatus of the invention.
Figure 2:
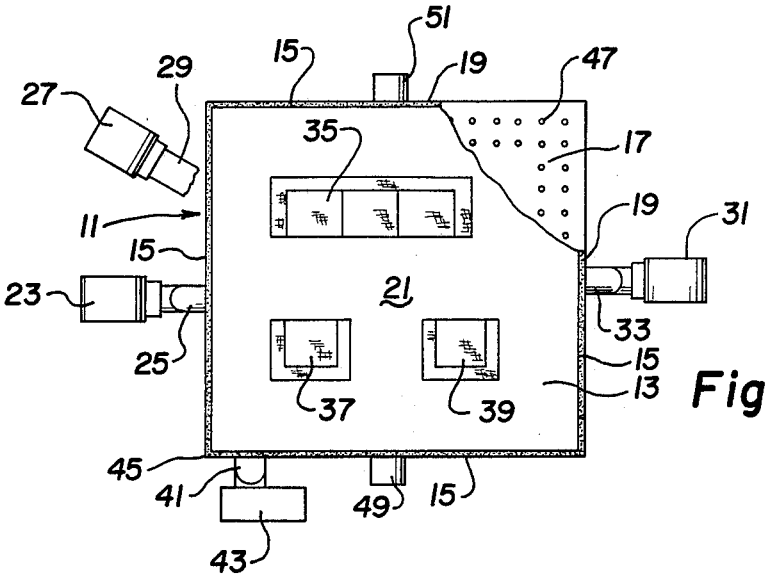
FIG. 2 is a top view of the apparatus of the invention with a section of the top broken away for clarity.

As illustrated in FIG. 1, the apparatus of the invention is a portable drying tent 11 having a floor 13, four sides 15, and a top 17. The floor 13 is preferably made of canvas, and the sides 15 and top 17 are preferably a lightweight plastic, such as parachute silk. Other materials of similar properties may also be used. The floor 13 must be tough to withstand the furniture placed upon it. The sides 15 and top 17 must be relatively lightweight.

The floor 13 is rectangular and the sides 15 extend upward from the floor 13. The top 17 is attached to the sides 15 by attachment means, such as a plurality of hook and fiber connectors 19 of the type sold under the trademark VELCRO. The floor 13, sides 15, and top 17 of the tent 11 form an enclosed chamber 21, large enough to contain the furniture to be treated.

An air blowing fan 23 is located near the tent 11 and blows air through a fan boot 25 or hose into the chamber 21. The fan boot 25 directs the air into the chamber 21 through the center of one of the sides 15. The fan 23 may also include a dehumidifier to reduce the humidity of the air, or a heater to heat the air, if desired.

A second air blowing fan 27 is also placed near the tent 11 and blows air through a second fan boot 29 into the chamber 21. The second fan boot 29 directs air into the chamber through the center of the top 17.

A third air blowing fan 31 may be located on the opposite side of the tent 11 from the first fan 23. The third fan 31 blows air through a third fan boot 33 into the chamber 21 through the center of the side 15 of the tent 11.

The air blowing into the chamber 21 from the three fans 23, 27, and 31 swirls around the furniture in the tent 11. The furniture may include a couch 35 and chairs 37 and 39, for example.

Ozone can be blown into the chamber 21 through an ozone boot 41 or hose connected to an ozone generator 43 located near the tent 11. The ozone boot 41 forces ozone into the chamber 21 near the top 17 of the tent 11 and a corner 45 to cause the ozone to spiral downward in a clockwise direction. Ozone is denser than air and will tend to sink through the tent 11.

As air or ozone is blown into the chamber 21, the tent 11 will inflate and the sides 15 and top 17 will be lifted off of the floor 13. The air or ozone escapes from the chamber 21 through exit means in the top 17 or sides 15 of the tent 11. The exit means is preferably a plurality of holes 47 in the top 47 of the tent 11. The number and size of the holes 47 are designed to allow the air or ozone to escape at a selected rate near or below the rate that the air or ozone is forced into the chamber 21. The inflation of the tent 11 is thus maintained.

The exit means may also include exhaust boots 49 and 51, located in the two sides 15 of the tent 11 that do not have fan boots 25 and 33. If desired, the exhaust boots 49 and 51 can be closed and tied off to restrict the flow of air out of the chamber 21. Alternatively, a corner of the top 17 can be disconnected and left open to allow air to exit the chamber 21.

The couch 35 and the chairs 37 and 39 are placed on the floor 13 of the tent 11 within the sides 15. Then, the top 17 is attached to the sides 15 by means of the connectors 19. When the fans 23, 27, and 31 or the ozone generator 43 are activated, air or ozone is blown into the tent 11 through the fan boots 25, 29, and 33 or the ozone boot 41. The air or ozone inflates the tent 11, causing the sides 15 and top 17 of the tent 11 to rise. The air or ozone swirls through the chamber 21 and exits through the holes 47 in the top 17 of the tent 11 or through the exhaust boots 49 and 51. Air circulating through the tent 11 causes water in furniture to evaporate, and ozone removes smoky odors from the furniture.

The apparatus of the invention has several advantages over the prior art. Since the tent 11 is portable, the furniture does not have to be transported to a special drying room. Also, the required drying time is greatly reduced. Drying time may be reduced to as low as fifteen minutes to twenty minutes.

The invention has been shown in only one of its embodiments. It should be apparent to those skilled in the art that the invention is not so limited, but is susceptible to various changes and modifications without departing from the spirit of the invention.

We claim:

1. An apparatus for treating damaged furniture, comprising:

a floor;

a plurality of sides extending upward from the floor to form a chamber for containing the furniture to be treated;

a top;

attachment means for attaching the top to the sides;

inflation means for forcing a gas into the chamber to raise the top and the sides off the floor, the inflation means including a dehumidifier to reduce the humidity of the gas; and exit means for allowing the gas to escape from the chamber at a selected rate.

2. An apparatus as defined in claim 1 wherein the attachment means further comprises a hook and fiber connector.

3. An apparatus as defined in claim 1 wherein the inflation means is an air blowing fan.

4. An apparatus as defined in claim 1 wherein the exit means is a plurality of holes through the top.

5. An apparatus as defined in claim 1 wherein the floor is canvas and the sides and top are plastic.

6. An apparatus as defined in claim 1 wherein the inflation means includes a heater to heat the gas.

7. An apparatus for treating damaged furniture, comprising:

a floor;

a plurality of sides extending upward from the floor to form a chamber for containing the furniture to be treated;

a top having a hole for allowing as within the chamber to escape the chamber at a selected rate;

a connector for attaching the top to the sides; and a fan for forcing a gas into the chamber at a rate that is at least as great as the rate at which the gas can escape through the hole in the top to raise the top and the sides off of the floor, the fan including a dehumidifier to reduce the humidity of the gas.

8. An apparatus as defined in claim 7 wherein the connector is a hook and fiber connector.

9. An apparatus as defined in claim 7 wherein the fan is an air blowing fan.

10. An apparatus as defined in claim 7 wherein the floor is canvas and the sides and top are plastic.

11. An apparatus as defined in claim 7 wherein the fan includes a heater to heat the gas.

12. An apparatus for treating damaged furniture, comprising: p1 a floor;

a plurality of sides extending upward from the floor to form a chamber for containing the furniture to be treated;

a top;

a connector for attaching the top tot he sides;

a fan for forcing a gas into the chamber to raise the top and the sides off of the floor;

an ozone generator for forcing ozone into the chamber near a top corner of the chamber to cause the ozone to spiral downward; and exit means for allowing the gas to escape from the chamber at a selected rate.

* * * * *